US010179969B2

(12) United States Patent
D'Heygere et al.

(10) Patent No.: US 10,179,969 B2
(45) Date of Patent: Jan. 15, 2019

(54) IRONER CHEST FOR AN IRONING DEVICE

(71) Applicant: WERKHUIZEN LAPAUW NV, Heule (BE)

(72) Inventors: Philippe D'Heygere, Menen (BE); Charles-Edouard Dendoncker, Orroir (BE); Koen Buydaert, Destelbergen (BE)

(73) Assignee: WERKHUIZEN LAPAUW NV, Heule (BE)

( * ) Notice: Subject to any disclaimer, the term of this patent is extended or adjusted under 35 U.S.C. 154(b) by 67 days.

(21) Appl. No.: 15/302,895

(22) PCT Filed: Apr. 2, 2015

(86) PCT No.: PCT/IB2015/052430
§ 371 (c)(1),
(2) Date: Oct. 7, 2016

(87) PCT Pub. No.: WO2015/155648
PCT Pub. Date: Oct. 15, 2015

(65) Prior Publication Data

US 2017/0121901 A1 May 4, 2017

(30) Foreign Application Priority Data

Apr. 7, 2014 (BE) ..... 2014/0232

(51) Int. Cl.
*D06F 67/08* (2006.01)
*D06F 65/02* (2006.01)

(52) U.S. Cl.
CPC ..... *D06F 67/08* (2013.01); *D06F 65/02* (2013.01)

(58) Field of Classification Search
CPC ..... D06F 67/00; D06F 67/08; D06F 63/00; D06F 63/02; D06F 65/00–65/10; D06F 69/00; D06F 69/04; D06F 71/36
See application file for complete search history.

(56) References Cited

U.S. PATENT DOCUMENTS 1,678,843 A 7/1928 Arnold
1,757,344 A 5/1930 Stoffel
(Continued)

FOREIGN PATENT DOCUMENTS

DE 216409 C 8/1969
DE 1800867 A1 8/1969
(Continued)

OTHER PUBLICATIONS

International Search Report dated Jul. 31, 2015.
"Platten-Warmetauscher," Nov. 13, 2013 (Nov. 13, 2013), XP055141592.

*Primary Examiner* — Ismael Izaguirre
(74) *Attorney, Agent, or Firm* — Symbus Law Group, LLC; Clifford D. Hyra

(57) ABSTRACT

An improved ironer chest for an ironing device, wherein said ironer chest is of a double-walled design and has an inner wall (1) and an outer wall (2), between which a chamber (3) extends through which a medium can flow, in which one or more elements (4) which increase heat transfer are arranged adjacent to the inner wall (1), and wherein the ironer chest comprises a partition wall (6) which is provided with passage openings (7) and which divides the chamber (3) into a first chamber (9) which contains the one or more elements (4) which increase heat transfer and a second chamber (5), adjacent to the outer wall (2), which is free from said elements (4) which increase heat transfer. In addition, the present invention relates to an ironing device comprising such an ironer chest.

19 Claims, 1 Drawing Sheet

(56) References Cited

U.S. PATENT DOCUMENTS

| | | | | | |
|---|---|---|---|---|---|
| 1,769,009 | A * | 7/1930 | Adams | D06F 67/08 38/9 |
| 1,769,010 | A * | 7/1930 | Adams | D06F 83/00 165/134.1 |
| 2,309,179 | A | 1/1943 | Ferris | |
| 2,910,791 | A | 11/1959 | Behrstock | |
| 3,013,351 | A | 12/1961 | Johnston | |
| 3,516,184 | A * | 6/1970 | Oberley | D06C 15/04 38/56 |
| 4,428,133 | A | 1/1984 | Kamberg | |
| 6,360,460 | B2 * | 3/2002 | Grandpierre | D06F 65/02 38/4 |

FOREIGN PATENT DOCUMENTS

| | | | | |
|---|---|---|---|---|
| DE | 3643901 | A1 | | 7/1987 |
| DE | 3838391 | A | * | 5/1990 |
| DE | 4443094 | A1 | | 6/1996 |
| EP | 2682516 | A2 | | 1/2014 |
| GB | 225699 | A | | 12/1924 |
| JP | 2003230799 | A | | 8/2003 |
| RU | 1786211 | A1 | * | 1/1993 |

* cited by examiner

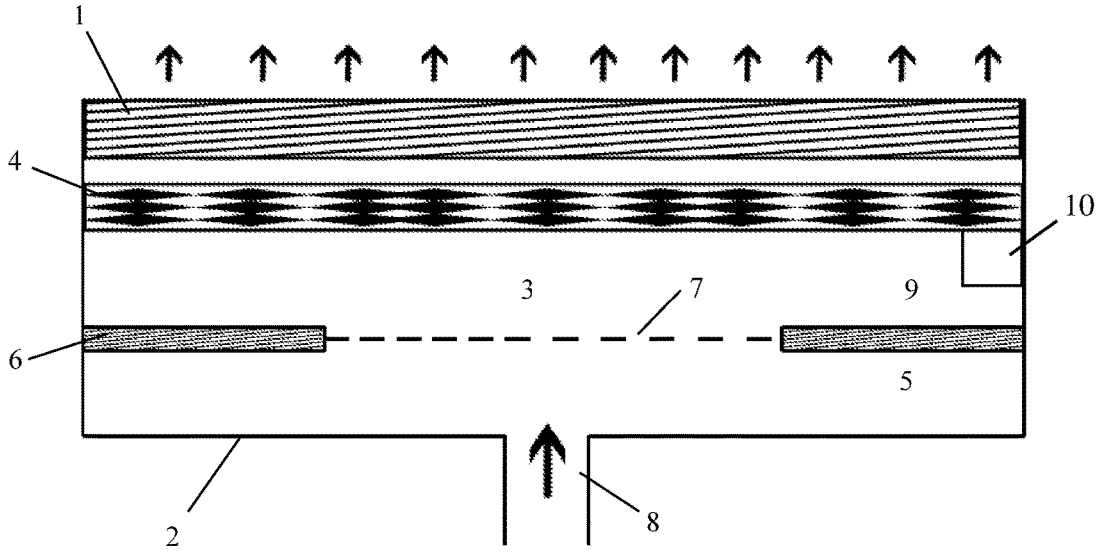
1
4
10
3
7
9
6
5
2
8

IRONER CHEST FOR AN IRONING DEVICE

This application claims the benefit of Belgian Patent Application No. BE-2014/0232, filed Apr. 7, 2014, which is hereby incorporated by reference in its entirety.

FIELD OF THE INVENTION

The present invention relates to an ironer chest for an ironing device, wherein said ironer chest is of a double-walled design and has an inner wall and an outer wall, between which a chamber extends through which a medium can flow. More specifically, the invention relates to a gas-fired ironer chest.

In addition, the present invention also relates to an ironing device which comprises such an ironer chest.

BACKGROUND

An ironer chest to which the present invention relates is described, for example, in BE 1 018 731 A5.

An ironing device to which the present invention relates is typically an industrial ironing device. Such an ironing device typically comprises one or more ironing rollers and one or more corresponding ironer chests. In this case, the inner wall of a ironer chest is in each case adjacent to the sleeve of a corresponding ironing roller. Laundry to be ironed is arranged between the ironing roller and the ironer chest in order to be ironed. By rotating the ironing roller, laundry to be ironed is carried along the inner wall of the ironer chest. The type of ironer chest to which the present invention relates is in this case heated by means of a medium. While the laundry to be ironed passes in between the ironing roller and the ironer chest, moisture is extracted from the laundry while being ironed. This moisture is typically carried away via the ironing roller.

In a gas-fired ironer chest, oil is heated as a medium by means of a gas burner and a heat exchanger. This oil is pumped through the chamber of the double-walled chest through which a medium can flow. However, the longer this oil is heated, the thicker it becomes, thus gradually clogging up the small holes in the chamber through which a medium can flow. These blocked holes form zones on the inner wall which have a lower temperature, as a result of which laundry to be ironed is no longer ironed evenly. Such gas-fired ironer chests therefore require regular maintenance in order to unblock blocked holes.

SUMMARY

An additional drawback of such gas-fired ironer chests is that oil is not always available as a medium.

It is the object of the present invention to provide an ironer chest which can be heated by gas, thus making it possible to avoid the use of oil.

This object of the invention is achieved by providing an ironer chest for an ironing device, wherein said ironer chest is of a double-walled design and has an inner wall and an outer wall, between which a chamber extends through which a medium can flow, in which one or more elements which increase heat transfer are arranged adjacent to the inner wall, and wherein said ironer chest comprises a partition wall which is provided with passage openings and which divides the chamber into a first chamber which contains the one or more elements which increase heat transfer and a second chamber, adjacent to the outer wall, which is free from said elements which increase heat transfer.

Due to the combination of elements which increase heat transfer and the partition wall which is provided with passage openings, it is possible to transfer heat efficiently from heating elements, such as for example gas burners, to the inner wall in a more uniform manner by means of the medium. To this end, it is no longer necessary to use oil as a medium, but air can for example be used as a medium instead. Providing the partition wall results in excellent heat convection with a particularly short transition time.

It was already known, for example from GB 2 225 699 A, to provide one or more elements which increase heat transfer, such as projections or ribs, etc. which form grooves, ducts, etc., in the chamber through which a medium can flow in mangle chests in general, adjacent to the inner wall.

However, such elements which increase heat transfer increased the heat transfer to an insufficient degree to be able to replace oil in gas-fired ironer chests as a medium. By means of a partition wall with passage openings, it is now possible to achieve this object.

To this end, such a partition wall may be of a porous design. These passage openings are preferably distributed evenly across the surface of this partition wall, so that this partition wall also functions as a flow distributor in order to make the flow of a medium towards the inner wall as uniform as possible.

Such a partition wall may be configured, for example, as a fine mesh or a fabric or a filter medium or as a perforated plate, etc.

Preferably, the partition wall has passage openings made from a metal alloy which is able to resist the temperatures occurring in the ironer chest.

A partition wall of a mangle chest according to the present invention preferably has an air permeability of between 945 $l/dm^2min$ and 3045 $l/dm^2min$ at an operating pressure of 200 Pa. More preferably, it has an air permeability of between 1785 $l/dm^2min$ and 2415 $l/dm^2min$. Most preferably, it has an air permeability of approximately 2100 $l/dm^2min$.

The one or more elements which increase heat transfer may be configured, for example, as fins, projections or ribs, etc. Preferably, these are made from metal. More preferably, these comprise metal foam.

Such a metal foam is a 3D porous material, made from metal. This metal foam comprises open cells. Preferably, this metal foam has a porosity of 80% or more and its pores preferably have a diameter between 3 and 5 mm.

The metal from which the metal foam is made may be, for example, aluminium, copper, nickel, magnesium or an alloy thereof. Preferably, this metal foam is made from an aluminium alloy.

In order to incorporate this metal foam in such an ironer chest, it may be attached thereto, for example, by means of sintering, soldering, welding, bonding using thermally conductive glue, epoxy paste, etc.

Incorporating such a metal foam results in excellent heat convection with a very short transition time. Due to the isotropic structure of this metal foam with a uniform distribution in 3D, the isothermal properties of the mangle chest may be improved.

The one or more elements which increase heat transfer of an ironer chest according to the present invention are preferably arranged adjacent to the inner wall in order to be able to directly transfer the heat of the metal foam onto this inner wall. In this case, these one or more elements which increase heat transfer (together) preferably extend across virtually the entire surface of the inner wall in order to achieve a heat distribution across the surface of the inner wall which is as uniform as possible. If only one single element which increases heat transfer is present, this preferably extends across virtually the entire surface of the inner wall. If several elements which increase heat transfer are present, these are preferably arranged next to one another in order to cover virtually the entire surface of the inner wall together.

Since the second chamber extends between the partition wall and the outer wall, the partition wall is arranged at an intermediate distance from the outer wall. Preferably, it runs virtually parallel to this outer wall. Preferably, it also runs virtually parallel to the inner wall. This partition wall is preferably also arranged at an intermediate distance from said one or more elements which increase heat transfer.

Preferably, an ironer chest according to the present invention comprises an inlet opening for letting in the medium and which is connected to the second chamber and an outlet opening for discharging the medium and which is connected to the first chamber.

An ironer chest according to the present invention furthermore preferably also comprises heating means for heating the medium. Gas burners or electrical resistors or IR burners, etc., may be selected as means of heating, for example, but gas burners are preferred.

Particularly preferably, the ironer chest comprises several gas burners as means of heating. These gas burners are then preferably distributed across the outer surface. In this case, gas burners are preferably selected which each have at most approximately 35 kW. Preferably, one such gas burner is provided for every 1.2 $m^2$ to 1.5 $m^2$ of outer wall.

An advantageous embodiment of an ironer chest according to the present invention comprises a temperature sensor which is arranged adjacent to the inner wall and comprises control means for controlling the means of heating, based on the temperature measured by the temperature sensor.

Preferably, such an embodiment comprises several temperature sensors, with the control means being provided to control the means of heating based on the temperatures measured by the different temperature sensors.

By means of these temperature sensors and control means, it is possible to systematically maintain the temperature of the ironer chest as evenly as possible at a desired value.

Air is advantageously chosen as the medium since air is freely available everywhere, contrary to the oil used in the prior art.

Of all the walls, preferably at least the inner wall is made from a heat-conducting material. At least one abovementioned wall of an ironer chest according to the present invention is preferably made from aluminium so that it can easily be shaped and made lightweight. Preferably, such a wall from aluminium is provided with a diamond layer to protect it from corrosion.

A specific embodiment of an ironer chest according to the present invention comprises one or more medium guides which are situated adjacent to the one or more elements which increase heat transfer in said chamber.

If such an ironer chest comprises an inlet opening for letting in the medium and comprises an outlet opening for discharging the medium, then preferably one or more such medium guides are arranged adjacent to the outlet opening.

An ironer chest according to the present invention preferably comprises several inlet openings which are preferably distributed across the surface of the outer wall. In this case, preferably one gas burner is provided for each inlet opening. If the abovementioned gas burners which are each at most approximately 35 kW are selected, then preferably one inlet opening is provided for every 1.2 $m^2$ to 1.5 $m^2$ of outer wall.

A specific ironer chest according to the present invention may comprise insulation which is arranged adjacent to the outer wall.

A particular ironer chest according to the present invention comprises several part-ironer chests, each of which comprise a said inner wall, a said outer wall, a said chamber through which medium can flow and one or more abovementioned elements which increase heat transfer.

Such a part-ironer chest, viewed in cross section of the ironer chest, preferably covers a part of the arc of the ironer chest.

The object of the present invention is furthermore also achieved by providing an ironing device which comprises an ironer chest according to the present invention.

BRIEF DESCRIPTION OF THE DRAWINGS

FIG. 1 illustrates an ironer chest, according to an embodiment of the present invention.

DETAILED DESCRIPTION

The present invention will now be explained in more detail by means of the following detailed description of a preferred embodiment of an ironer chest according to the invention. The sole aim of this description is to provide an illustrative example and to indicate further advantages and particulars of the present invention and can therefore by no means be interpreted as a limitation of the area of application of the invention or of the patent rights defined in the claims.

Reference numerals are used in this detailed description to refer to the attached drawing, which diagrammatically shows a part of an ironer chest according to the present invention in cross section.

The partially illustrated ironer chest is of a double-walled design and has an inner wall (1), which is provided so as to adjoin an ironing roller, and an outer wall (2). Between the inner wall (1) and the outer wall (2), a partition wall (6) is arranged which divides the chamber (3) through which air can flow between the inner wall (1) and the outer wall (2) into two parts, i.e. a first chamber (9) and a second chamber (5). This partition wall (6) is provided with passage openings (7).

The space (5) between the partition wall (6) and the outer wall (2) is empty. If desired, air-guiding elements may be arranged therein for guiding air. At the bottom of the outer wall (2), an inlet opening (8) is provided which is provided in order to place a gas burner underneath it. Alternative heating elements are conceivable, but are less preferred. Air is heated by means of this gas burner and flows into the chamber through which air can flow via the inlet opening (8). This air then flows further through the passage openings (7) of the partition wall (6), which act as flow distributors, to the part (9) of the chamber (3) through which air can flow between the inner wall (1) and the partition wall (6), i.e. the first chamber (9). This part (9) contains metal foam (4) which extends virtually across the entire surface of the inner wall (1). Laterally from this upper space (9), outlet openings (not shown) are provided, via which the air can leave the chamber (3) through which air can flow again. Air-guiding elements (10), illustrated schematically, may be arranged towards these outlet openings in order to streamline the discharge.

The metal foam (4) is a 3D porous material, made from metal, such as for example aluminium. This metal foam comprises open cells having pores with a diameter of 3 to 5 mm. The porosity thereof is greater than 80%.

Due to this metal foam, the heat of the air heated by means of the gas burners is transferred to the inner wall in a uniform manner.

It is also possible to arrange one or more other elements which increase heat transfer in this first chamber (9) instead of this metal foam (4) or together with this metal foam (4).

The walls are made from a heat-conducting material, such as for example aluminium. An aluminium wall is preferably provided with a diamond layer to protect it from corrosion.

An ironer chest according to the present invention may comprise several illustrated parts, evenly distributed across the surface of the mangle chest in such a manner that, for every 1.2 $m^2$ to 1.5 $m^2$ of outer wall, one inlet opening is provided with a gas burner underneath it which has at most 35 kW.

In order to make the temperature of the inner wall (1) as uniform as possible, the ironer chest furthermore comprises several sensors which are arranged adjacent to the inner wall (1). Furthermore, the ironer chest comprises control means for controlling the gas burners based on the temperature measured by the temperature sensors.

The invention claimed is:

1. An ironer chest for an ironing device, wherein said ironer chest is of a double-walled design and has an inner wall and an outer wall, between which a chamber extends through which a medium can flow for heating the inner wall, in which one or more elements which increase heat transfer are arranged adjacent to the inner wall for increasing heat transfer to the inner wall, wherein the ironer chest comprises a partition wall which is provided with passage openings for the medium and which divides the chamber into a first chamber which contains the one or more elements which increase heat transfer and a second chamber, adjacent to the outer wall, which is free from said one or more elements which increase heat transfer; wherein the one or more elements which increase heat transfer comprise metal foam.

2. The ironer chest according to claim 1, characterized in that the one or more elements which increase heat transfer extend across virtually the entire surface of the inner wall.

3. The ironer chest according to claim 1, characterized in that the partition wall is arranged at a distance from said one or more elements which increase heat transfer.

4. The ironer chest according to claim 1, characterized in that the ironer chest comprises an inlet opening for letting in the medium and which is connected to the second chamber and comprises an outlet opening for discharging the medium and which is connected to the first chamber.

5. The ironer chest according to claim 1, characterized in that the ironer chest comprises a heater for heating the medium.

6. The ironer chest according to claim 5, characterized in that the heater comprises several gas burners.

7. The ironer chest according to claim 5, characterized in that the ironer chest comprises a temperature sensor which is arranged adjacent to the inner wall and comprises a controller for controlling the heater, based on the temperature measured by the temperature sensor.

8. The ironer chest according to claim 1, characterized the medium is air.

9. The ironer chest according to claim 1, characterized in that at least one abovementioned wall is made from aluminum.

10. The ironer chest according to claim 1, characterized in that the ironer chest comprises one or more medium guides which are situated adjacent to the one or more elements which increase heat transfer in said chamber.

11. The ironer chest according to claim 4, characterized in that one or more abovementioned medium guides are situated adjacent to the outlet opening.

12. The ironer chest according to claim 1, characterized in that it comprises several part-ironer chests, each of which comprise a said inner wall, a said outer wall, a said chamber through which a medium can flow and one or more elements which increase heat transfer.

13. The ironer chest according to claim 12, characterized in that each part-ironer chest, viewed in cross section of the ironer chest, covers a part of the arc of the ironer chest.

14. Ironing device characterized in that it comprises an ironer chest according to claim 1.

15. An ironer chest for an ironing device, wherein said ironer chest is of a double- walled design and has an inner wall and an outer wall, between which a chamber extends through which a medium can flow for heating the inner wall, in which one or more elements which increase heat transfer are arranged adjacent to the inner wall for increasing heat transfer to the inner wall, wherein the ironer chest comprises a partition wall which is provided with passage openings for the medium and which divides the chamber into a first chamber which contains the one or more elements which increase heat transfer and a second chamber, adjacent to the outer wall, which is free from said one or more elements which increase heat transfer, wherein the partition wall is a perforated plate, mesh, fabric, or filter medium.

16. The ironer chest of claim 15, wherein the partition wall has an air permeability of between 945 $l/dm^2min$ and 3045 $l/dm^2min$ at an operating pressure of 200 Pa.

17. The ironer chest of claim 16, wherein the partition wall has an air permeability of between 1785 $l/dm^2min$ and 2415 $l/dm^2min$ at an operating pressure of 200 Pa.

18. The ironer chest of claim 15, wherein the partition wall is a perforated plate.

19. The ironer chest of claim 18, wherein and the passage openings are distributed evenly across a surface of the perforated plate.

* * * * *